US010723418B2

(12) United States Patent
Gasparro

(10) Patent No.: US 10,723,418 B2
(45) Date of Patent: Jul. 28, 2020

(54) EDGE RAILS IN A SURFBOARD

(71) Applicant: Gianfranco Gasparro, Hermosa, CA (US)

(72) Inventor: Gianfranco Gasparro, Hermosa, CA (US)

( * ) Notice: Subject to any disclaimer, the term of this patent is extended or adjusted under 35 U.S.C. 154(b) by 0 days.

(21) Appl. No.: 16/198,528

(22) Filed: Nov. 21, 2018

(65) Prior Publication Data

US 2019/0193819 A1 Jun. 27, 2019

Related U.S. Application Data

(60) Provisional application No. 62/590,044, filed on Nov. 22, 2017.

(51) Int. Cl.

| | |
|---|---|
| ***B63B 32/50*** | (2020.01) |
| ***B63B 32/57*** | (2020.01) |
| ***B63B 32/53*** | (2020.01) |
| ***B63B 32/60*** | (2020.01) |

(52) U.S. Cl.

CPC ..... *B63B 32/57* (2020.02); *B63B 32/50* (2020.02); *B63B 32/53* (2020.02); *B63B 32/60* (2020.02)

(58) Field of Classification Search

CPC ..... B63B 35/79; B63B 2035/7903; B63B 35/7906; B63B 32/50; B63B 32/70; B63B 32/60; B63B 32/57

USPC ..... D21/769

See application file for complete search history.

(56) References Cited

U.S. PATENT DOCUMENTS

| | | | | |
|---|---|---|---|---|
| 4,719,952 | A | 1/1988 | Geronimo | |
| 5,618,215 | A * | 4/1997 | Glydon | B63B 1/34 114/67 R |
| 7,985,111 | B2 | 7/2011 | Gasparro | |
| 9,809,284 | B2 * | 11/2017 | Hantz | B63B 35/7906 |
| 2010/0136861 | A1 * | 6/2010 | Burke | B63B 35/7906 441/79 |

FOREIGN PATENT DOCUMENTS

| | | | | |
|---|---|---|---|---|
| WO | 2018126294 | A1 * | 1/2017 | B63B 1/042 |

* cited by examiner

*Primary Examiner* — Andrew Polay

(74) *Attorney, Agent, or Firm* — Thomas Schneck

(57) ABSTRACT

A surfboard having laterally opposed pairs of axial or lengthwise grooves with the pair forming opposed rails of greater stiffness and reduced mass. At least one of the grooves of each pair is at a board edge extremity and the other groove is nearby, preferably near or on the lower side of the surfboard. The grooves may be laid up with epoxy or fiberglass.

21 Claims, 3 Drawing Sheets

EDGE RAILS IN A SURFBOARD

CROSS-REFERENCE TO RELATED APPLICATION

This patent application claims priority from U.S. Provisional Patent Application Ser. No. 62/590,044 filed on Nov. 22, 2017.

TECHNICAL FIELD

The present invention relates to a surfboard with edgewise grooves and nearby ancillary grooves configured in symmetric pairs that provide improved rails for superior surfboard control when the surfboard encounters waves.

BACKGROUND ART

Surfboard rails extend along opposed lateral edges of a surfboard from the nose to the tail of the board. The rails serve to guide water around the board when the board encounters a wave. Such guiding serves to control the board by providing edgewise board bite or slicing into a water wall allowing a board carrying a rider to have horizontal support from a partly vertical wall of water. In the past, it was thought that harder rails allow better board edge support from a wave. Hard rails were thought to have less resistance in cutting through the water, just like a sharp knife slices meat. Yet, rails have to be a compromise between slicing ability and buoyancy with hard rails having less buoyancy compared to soft rails.

U.S. Pat. No. 9,809,284 to D. Hantz discloses a lightweight surfboard with a set of channels or grooves shaped into a top portion of the body of the surfboard. The channels or grooves comprise a pair of adjacent, axially extending elongated concave grooves that run along the length of the board, meeting at end points. The purpose of the grooves is to prevent the board from breaking due to bending of the surfboard while being ridden on the wave. FIG. 5 herein shows a single edgewise groove that is concave in cross section that is known in the prior art and used for surfboard control.

In U.S. Pat. No. 4,719,952 rails are described as presenting a low drag edge at an angle in contact with the surface of a wave much like the edges of a conventional snow ski. Rails are further described as essential for effective control of the surfboard in the water. The comparison of surfboard rails to hard edges of snow skis is consistent with the construction of prior art surfboards with rail hardness and thickness being principal variable factors.

An object of the invention was to devise an improved rail configuration that both improves floatation and improves surfboard control.

SUMMARY OF DISCLOSURE

The above object has been achieved in a surfboard with rails on each opposed lateral side of the board having an edgewise concave groove with a nearby ancillary concave groove, with both grooves optionally having carbon fiber or fiberglass lay-ups. The board has an axial or lengthwise axis of symmetry, with pairs of grooves on opposite lateral sides of the axis in symmetric relationship. This structure provides an improved surfboard rail configuration associated with each opposite lateral side of a surfboard. I have found that pairs of such grooves forming opposed rails give greater board control and rail performance in surfboards while achieving favorable floatation characteristics due to mass reduction rather than mass increase by prior art rails.

The present invention improves performance of a surfboard, i.e., the ability to perform stunts, by greater edge-to-edge definition that rises from a pair of lengthwise grooves on each side of the surfboard that are parallel to each other for most of the length of the board and form a stiff board-to-water edge interface.

DETAILED DESCRIPTION

A typical surfboard has a forward nose section and a rearward tail section with a length or axis and characteristic floatation in water capable of supporting a man. The board has a thickness for floatation with opposed lateral edges defining the edgewise thickness of the board, while central regions between the edges can be thicker.

Figure 1:
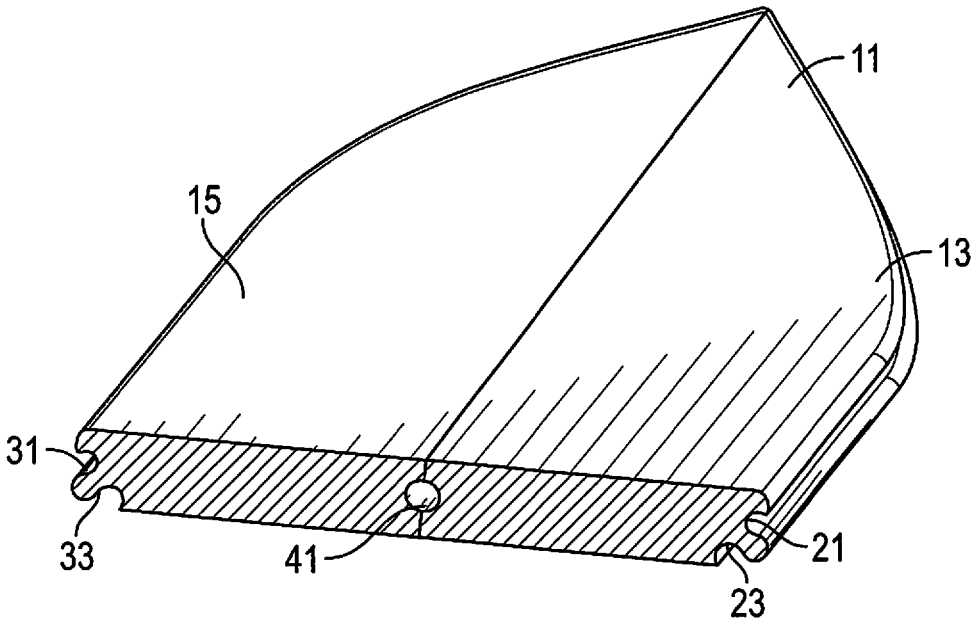
FIG. 1 is a perspective cutaway view of a surfboard portion looking towards the tail end of the surfboard, showing cross sections of edgewise concave grooves forming surfboard rails, each groove at an edgewise extremity having a nearby ancillary concave groove on each lateral side of the board.

With reference to FIG. 1, a surfboard tail portion 11 is shown to have a first edgewise concave groove 21 in the right edge extremity of the board and a nearby ancillary second concave groove 23 which is parallel to groove 21 and separated only by a short distance, such as a few centimeters, usually less than 10 cm. Both of the first and second grooves form an edge rail configuration for a surfboard. The opposite lateral side of the board 15 has a similar or mirror image edgewise concave groove 31 with a nearby ancillary concave groove 33 spaced in mirror image relationship relative to grooves 21 and 23, forming an edge rail configuration on the opposite lateral side of the surfboard. The surfboard may have an optional central axial stringer 41, such as a carbon fiber stringer of the type shown and claimed in U.S. Pat. No. 7,985,111 to Gianfranco Gasparro.

Figure 2:
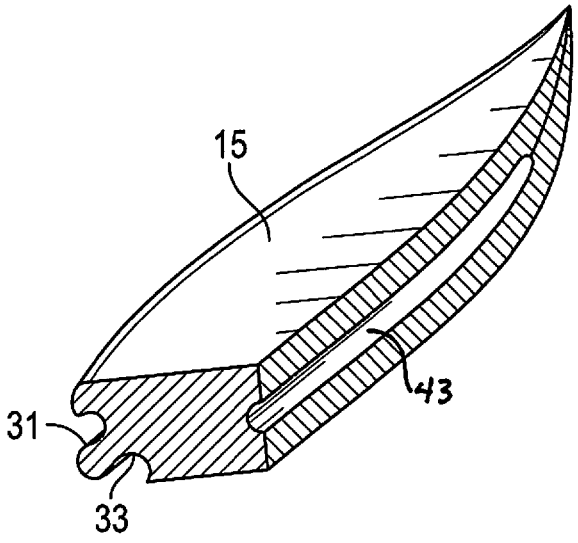
FIG. 2 is a perspective cutaway of another surfboard portion viewed towards the forward or nose quarter of a surfboard, showing an edgewise concave groove with a nearby ancillary concave groove both in cross section, as in FIG. 1 forming surfboard rails.

With reference to FIG. 2, the board portion 15 is seen to contain an axial carbon fiber stringer 43 as described in the previous patent of Gasparro. Such a carbon fiber stringer is optional, but adds strength and flexibility to a surfboard. Lengthwise concave grooves 31 and 33 are seen on the left side of the board. The grooves extend toward the nose of the board and are tapered to a very small dimension, such as a few millimeters. Groove 31 is at a lateral edge of the board portion, while groove 33 is slightly laterally inward, toward stringer 41 and may be on the underside of the board, usually less than 10 cm away.

Figure 3:
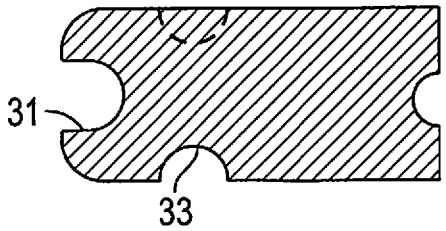
FIG. 3 is a side sectional view of a portion of a surfboard, similar to FIG. 1, showing an edgewise concave groove with a nearby ancillary concave groove, both in cross section in a surfboard.

With reference to FIG. 3, edgewise groove 31 is seen to be a concave semi-circular groove having a maximum diameter of about 2 centimeters. The groove 31 resides in a lateral edge of a surfboard which is usually rounded at the edge. Groove 33 has approximately the same dimensions as groove 31 and is spaced approximately 2-10 centimeters away, edge-to-edge of the groove 31. There can be areawise variance between the grooves, but typically not more than 100%. Groove 33 is axially inward of groove 31 toward stringer 43 in the underside of the board. Grooves 31 and 33 may have different dimensions and shapes, such as polygonal shapes, illustrated in FIG. 4. Groove 33 is axially parallel to groove 31 and extends the same length along or near an edge of the board, both grooves forming an edge rail.

Figure 4:
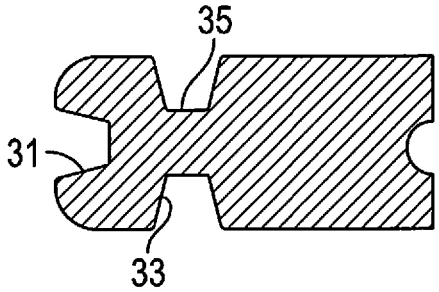
FIG. 4 is a side sectional view of a portion of a surfboard, as in FIG. 3, showing an edgewise concave groove with two nearby ancillary concave grooves, all in cross section.

With reference to FIG. 4, in addition to polygonal grooves 31 and 33, behaving as described in FIG. 3, an additional lengthwise groove 35 is positioned near or on the top deck of the surfboard, approximately opposite groove 33 and spaced approximately an equal distance from groove 31 as groove 33, but close enough so that all grooves might make water contact when a board edge bites into a wave wall of water and be considered as an edge rail configuration. The grooves 31 and 33, as well as groove 35, can be laid up with epoxy and carbon fiber, or fiberglass, to form a concave surfboard rail that has increased stiffness but decreased mass. I have found that pairs of edgewise grooves that are layered with carbon fiber material or fiberglass form improved rails in performance surfboards. Carbon fiber or fiberglass increase stiffness while protecting the board from water penetration at the groove location. The greater stiffness resists wave wash over the top of the board as the edge of the board bites into a wave wall of water at the edge interface between the water and the board.

Figure 5:
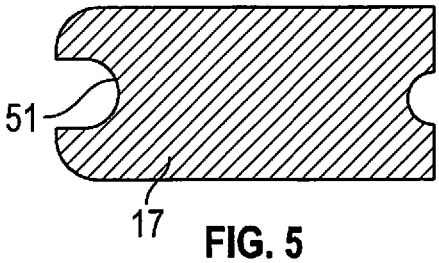
FIG. 5 (Prior Art)
FIG. 5 is a side sectional view of a portion of a surfboard showing a single edgewise concave groove, known in the prior art, as described above.

FIG. 5 shows an edge groove 51 at a surfboard 17 that is known in the prior art. The dimensions and precise location of the groove are not known but have been observed in use by others.

Figure 6:
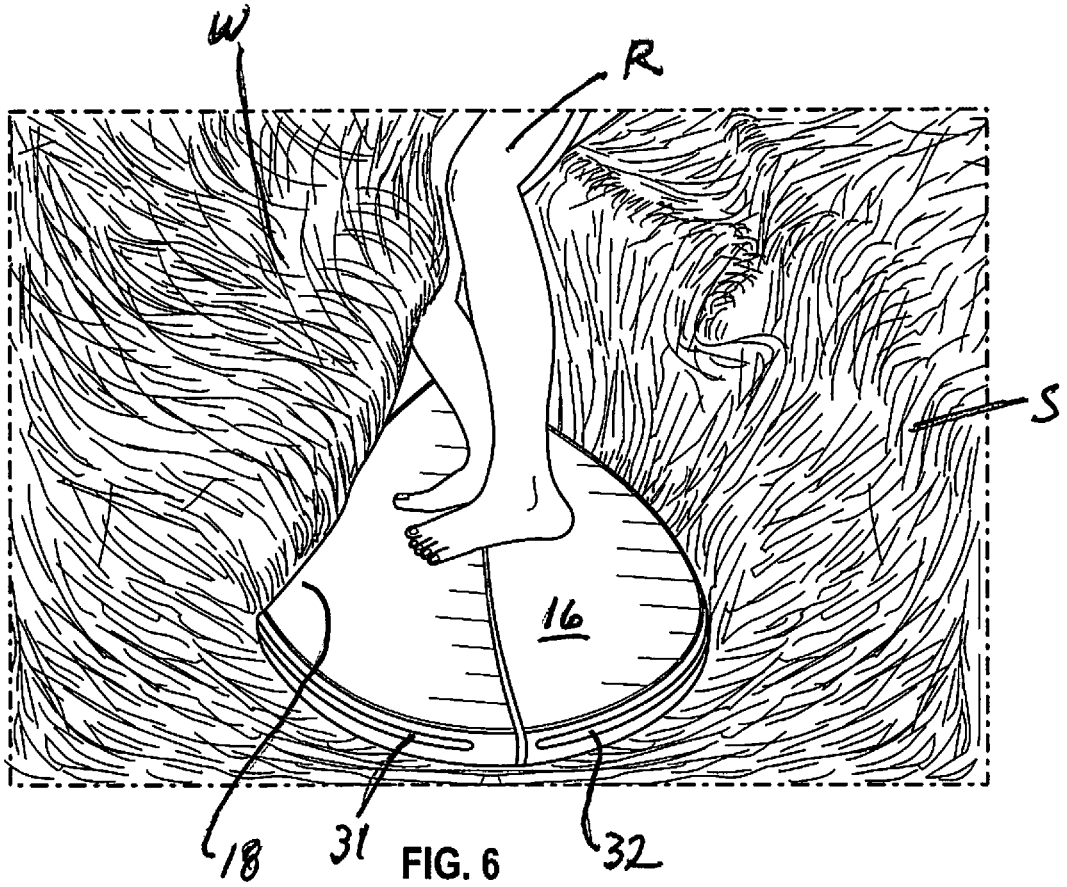
FIG. 6 is an action view of a surfboard with rider with the surfboard having an edge rail configuration as described in FIG. 1.

With reference to FIG. 6, a surfboard 16, supporting rider R, is seen having a left side 18 biting into a wall of water 20 formed by a wave. Left side 18 has an edgewise groove 31 and an ancillary groove as described in FIGS. 1-3, but not shown. The edgewise groove 31 and ancillary groove that together form a rail allow the board to slice through water wall, W, without capsizing, maintaining good board stiffness for rider control. An opposed edgewise groove 32 and corresponding ancillary groove have a lesser role, but here the rail configuration is deflecting water toward the shore direction, S, while assisting in providing board stiffness and floatation.

What is claimed is:

1. A surfboard comprising:

a floatation board having a nose and a tail at lengthwise ends and with a thickness defining opposed lateral edges, with the board capable of supporting a person in water; and a pair of parallel spaced apart lengthwise grooves on each lateral side of a surfboard, with a first of the pair of grooves being a concave indentation in a lateral edge of the board and a second of the grooves being less than 10 cm away from the first groove.

2. The surfboard of claim 1 wherein at least one of the spaced apart grooves is semi-circular.

3. The surfboard of claim 1 wherein each of the spaced apart grooves is semi-circular.

4. The surfboard of claim 1 wherein at least one of the spaced apart grooves is polygonal.

5. The surfboard of claim 1 wherein each of the spaced apart grooves is polygonal.

6. The surfboard of claim 1 wherein at least one of the spaced apart grooves is laid up with carbon fiber.

7. The surfboard of claim 1 wherein at least one of the spaced apart grooves is laid up with fiberglass.

8. The surfboard of claim 1 wherein the parallel spaced apart grooves at one lateral edge of the board are a mirror image of spaced apart grooves at an opposite edge of the board.

9. The surfboard of claim 1 having a carbon fiber stringer.

10. A control and floatation improvement for surfboards and the like comprising:

a floatation board having a nose and a tail at lengthwise ends and with a thickness defining opposed lateral edges, with the board capable of supporting a person in water;

a first concave lengthwise groove at the first edge of a surfboard;

a second concave groove at least partly parallel to the first concave groove but slightly spaced therefrom, the first and second concave grooves forming a first edge rail for the surfboard;

a third concave lengthwise groove at a second edge of the surfboard; and a fourth concave groove at least partly parallel to the third concave groove but slightly spaced therefrom, the third and fourth concave grooves forming a second edge rail for the surfboard in symmetric relation to the first edge rail.

11. The apparatus of claim 10 wherein the first and third grooves are semi-circular.

12. The apparatus of claim 11 wherein the second and fourth grooves are semi-circular.

13. The apparatus of claim 10 wherein the first and third grooves are polygonal.

14. The apparatus of claim 13 wherein the second and fourth grooves are polygonal.

15. The apparatus of claim 10 wherein each groove is laid up with carbon fiber.

16. The apparatus of claim 10 wherein each groove is laid up with fiberglass.

17. The apparatus of claim 10 in a surfboard having a carbon fiber stringer.

18. A surfboard comprising:

a floatation board with a lengthwise central axis having a nose and a tail at lengthwise ends and with a thickness defining opposed lateral edges, with the board capable of supporting a person in water;

a pair of parallel spaced apart lengthwise grooves on each lateral side of a surfboard, with a first of the pair of grooves being a concave indentation in a lateral edge of the board and a second of the grooves being less than 10 cm away from the first groove; and a carbon fiber stringer contained axially in the board.

19. A control and floatation improvement for surfboards and the like comprising:

a first concave groove at the first edge of a surfboard, the surfboard having a thickness defining opposed lateral edges;

a second concave groove at least partly parallel to the first concave groove but slightly spaced therefrom, the first and second concave grooves forming a first edge rail for the surfboard within the first edge;

a third concave groove at a second edge of the surfboard; and a fourth concave groove at least partly parallel to the third concave groove but slightly spaced therefrom, the third and fourth concave grooves forming a second edge rail for the surfboard in symmetric relation to the first edge rail.

20. The apparatus of claim 19 wherein each groove is laid up with carbon fiber.

21. The apparatus of claim 19 in a surfboard having a carbon fiber stringer.

* * * * *